US011854457B2

(12) United States Patent
Choi et al.

(10) Patent No.: US 11,854,457 B2
(45) Date of Patent: Dec. 26, 2023

(54) SELECTIVE BLACK LEVEL CONTROL IN ACTIVE MATRIX DISPLAYS

(71) Applicant: Google LLC, Mountain View, CA (US)

(72) Inventors: Sangmoo Choi, San Jose, CA (US); Daniel Solomon, San Jose, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 17/910,641

(22) PCT Filed: Jul. 30, 2021

(86) PCT No.: PCT/US2021/043960

§ 371 (c)(1),
(2) Date: Sep. 9, 2022

(87) PCT Pub. No.: WO2023/009141

PCT Pub. Date: Feb. 2, 2023

(65) Prior Publication Data

US 2023/0298505 A1 Sep. 21, 2023

(51) Int. Cl.
*G09G 3/20* (2006.01)
*G09G 3/3225* (2016.01)

(52) U.S. Cl.
CPC ..... *G09G 3/2074* (2013.01); *G09G 3/3225* (2013.01); *G09G 2300/08* (2013.01); *G09G 2310/0202* (2013.01); *G09G 2320/0233* (2013.01); *G09G 2320/0242* (2013.01); *G09G 2340/0435* (2013.01)

(58) Field of Classification Search
None
See application file for complete search history.

(56) References Cited

U.S. PATENT DOCUMENTS

2004/0196238 A1 10/2004 Pfeiffer et al.
2011/0051006 A1* 3/2011 Iisaka ..... G09G 3/3648 348/E5.119
2013/0236091 A1* 9/2013 Ubillos ..... G06F 3/04845 382/163

FOREIGN PATENT DOCUMENTS

CN 111063289 4/2020
EP 2293280 3/2011

OTHER PUBLICATIONS

International Search Report and Written Opinion in International Appln. No. PCT/US2021/043960, dated Apr. 25, 2022, 12 pages.

* cited by examiner

*Primary Examiner* — Stephen T. Reed
(74) *Attorney, Agent, or Firm* — Fish & Richardson P.C.

(57) ABSTRACT

A method includes: (a) receiving initial image frame data to display an image frame on a display panel, a luminance of each pixel of the display corresponding to a gray level; (b) identifying dark pixels at or below a first threshold gray level; (c) identifying pixels to be modified as a subset of the dark pixels neighbored by at least one bright pixel exceeding a second threshold gray level; (d) increasing by an incremental amount the gray level of the pixels to be modified, providing modified image frame data composed of: (i) the dark pixels that are neighbored by at least one bright pixel having gray levels that have been increased by the incremental gray level amount, and (ii) other pixels that have gray levels from the initial image frame data; and (e) displaying the image frame using the modified image frame data.

20 Claims, 6 Drawing Sheets

SELECTIVE BLACK LEVEL CONTROL IN ACTIVE MATRIX DISPLAYS

CROSS-REFERENCE TO RELATED APPLICATION

This application is a National Stage Application under 35 U.S.C. § 371 and claims the benefit of International Application No. PCT/US2021/043960, filed on Jul. 30, 2021. The disclosure of the prior application is considered part of and is incorporated by reference in the disclosure of this application.

FIELD OF THE DISCLOSURE

The disclosure relates to operation of active matrix displays, particularly to control of black levels in such display.

BACKGROUND

Active matrix displays, such as active matrix organic light emitting diode (AMOLED) displays, are widely used in many devices, such as mobile phones, tablet computers, laptop computers, and desktop displays. A trend in AMOLED display development has been to increase display resolution and the refresh rate/frame rate. For example, QHD/4 k resolution and 120 Hz refresh rate are presently common in AMOLED displays used in mobile phones. A result of this trend is increasing demand on the display driver circuitry to drive displays with high resolutions and fast refresh rates. For example, the time available to a column driver circuit to transfer gray level voltage data to a pixel circuit (referred to as the "row line time") for a QHD (i.e., 1440×3200) resolution display with a 120 Hz refresh rate is only 2.6 μs, compared to a FHD (i.e., 1080×2340) 60 Hz display which has a row line time of 7.1 μs row line.

As the row line time becomes very short, it becomes more challenging for the column line driver integrated circuits (ICs) to fully charge the data lines to the target $V_{DATA}$ level within the given row line time. Consequently, pixels in the display may reproduce incorrect luminance or color on the screen.

SUMMARY

Techniques are disclosed for reducing undesirable effects of resistance/capacitance load of data lines in active matrix displays, such as in displays with high resolution and high refresh rates. In particular, gray levels of black or near black pixels can be increased slightly for certain dark pixels to reduce a dynamic range of data voltage needed to address adjacent pixels on a data line. Such techniques can reduce undesirable visual artifacts in a displayed image frame that may result from inadequate pixel charging due to the finite rise and decay time of the data voltage.

In general, in a first aspect, the disclosure features a method, including: (a) receiving, by a computing system, initial image frame data corresponding to an image frame for display on a display panel, the display panel including an array of pixels electrically connected to display driver circuitry of the computing system, wherein a luminance of each pixel of the display panel during presentation of the image frame corresponds to a voltage provided to the pixel based on a gray level for that respective pixel in the initial image frame data; (b) identifying, by the computing system, dark pixels corresponding to pixels in the image frame for which the gray levels of the respective pixels are at or below a first threshold gray level, according to the initial image frame data; (c) identifying, by the computing system, pixels to be modified corresponding to a subset of the dark pixels that are neighbored by at least one bright pixel with a gray level at or exceeding a second threshold gray level, according to the initial image frame data; (d) increasing by an incremental gray level amount, by the computer system, the gray level of the pixels to be modified, to provide modified image frame data composed of: (i) the dark pixels that are neighbored by at least one bright pixel having gray levels that have been increased with respect to gray levels in the initial image frame data by the incremental gray level amount, and (ii) other pixels that have gray levels from the initial image frame data; and (e) displaying the image frame on the display panel using the modified image frame data.

Implementations of the method can include one or more of the following feature and/or features of other aspects. For example, identifying the pixels to be modified can further include identifying the pixels to be modified by the computing system as dark pixels that are not neighbored (e.g., vertically neighbored) by another dark pixel.

The method can include varying at least one of the first threshold gray level, the second threshold gray level, and the incremental gray level amount based on a brightness setting of the display panel. The computing system can be configured: for a first brightness setting, to set the incremental gray level amount to a first value; and for a second brightness setting that is lower than the first brightness setting, to set the incremental gray level amount to a second value that is lower than the first value.

The pixels to be modified can only be pixels located at or near an edge of the display panel.

The display panel can be a full color active matrix display panel and the dark pixels are identified based on a gray level for each color subpixel, according to the initial image frame data.

The display panel can be a full color active matrix display panel and the dark pixels can be identified based on a gray level for only one color subpixel, according to the initial image frame data.

Values for the incremental gray level amount can be different for data lines having different lengths, each data line of the display panel delivering the voltages to a corresponding column of pixels. A first value for the incremental gray level amount can be greater for a first data line than a second value for the incremental gray level amount for a second data line that is shorter than the first data line.

A dynamic range of a voltage applied to a pixel when displaying the image frame can be reduced using the modified image frame data compared to a dynamic range of the voltage applied to the pixel for the initial image frame data.

The display panel can be refreshed with a refresh rate of 60 Hz or higher.

The display panel can have a Full High Definition resolution or greater.

In general, in another aspect, the invention features a device that includes a display panel having an array of pixels, wherein a luminance of each pixel of the display panel during presentation of an image frame corresponds to a voltage provided to the pixel based on a gray level for that respective pixel in the initial image frame data; and a computing system in communication with the display panel and configured to provide the voltages to the pixels during operation of the device, wherein the computing system is configured to: (a) receive initial image frame data corresponding to the image frame for display on the display panel; (b) identify dark pixels corresponding to pixels in the image frame for which the gray levels of the respective pixels are at or below a first threshold gray level, according to the initial image frame data; (c) identify pixels to be modified corresponding to a subset of the dark pixels that are neighbored by at least one bright pixel with a gray level at or exceeding a second threshold gray level, according to the initial image frame data; (d) increase by an incremental gray level amount the gray level of the pixels to be modified, to provide modified image frame data composed of: (i) the dark pixels that are neighbored by at least one bright pixel having gray levels that have been increased with respect to gray values in the initial image frame data by the incremental gray level amount, and (ii) other pixels that have gray levels from the initial image frame data; and (e) display the image frame on the display panel using the modified image frame data.

Embodiments of the device can include one or more of the following features. For example, the computing system can include a column line driver and a scan line driver, the column line driver and scan line driver being configured to synchronously apply voltages to column lines and scan lines of the display panel, respectively, to display the image frame on the display panel using the modified image frame data.

The display panel can be a full color active matrix display panel.

The computing system can be configured so that the pixels to be modified are only pixels located at or near an edge of the display panel.

The computing system can be configured so that a dynamic range of a voltage applied to a pixel when displaying the image frame is reduced using the modified image frame data compared to a dynamic range of the voltage applied to the pixel for the initial image frame data.

The display panel can have a resolution of Full High Definition or higher.

The display panel can be an organic light emitting diode (OLED) display panel.

The device can be a smart phone, a tablet computer, or a wearable device. Other advantages will be apparent from the description, the figures, and the claims.

BRIEF DESCRIPTION OF THE DRAWINGS

Like symbols in the drawings designate like elements.

DETAILED DESCRIPTION

Figure 1B:
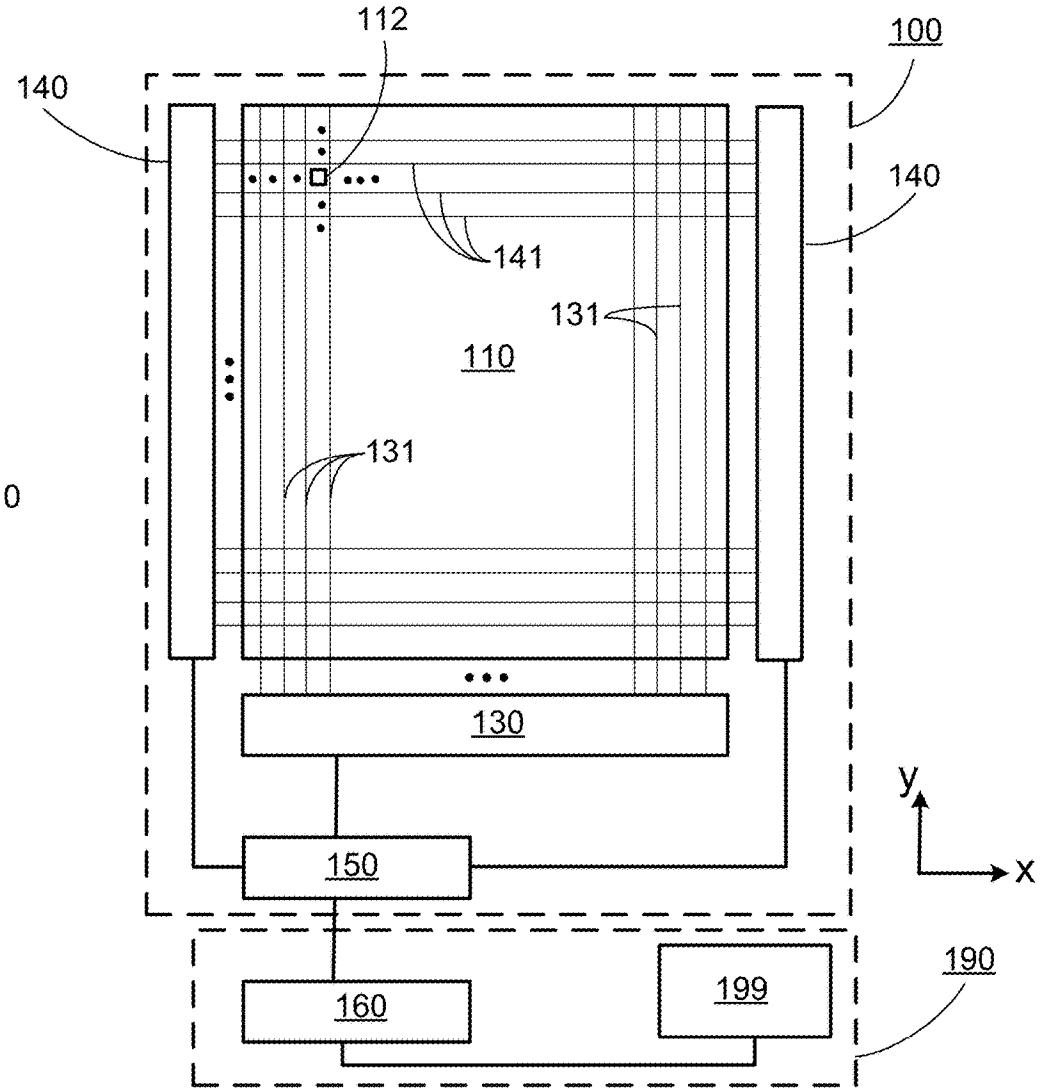
FIG. 1B is a schematic diagram of an example system including the AMOLED display panel shown in FIG. 1A.
Figure 1A:
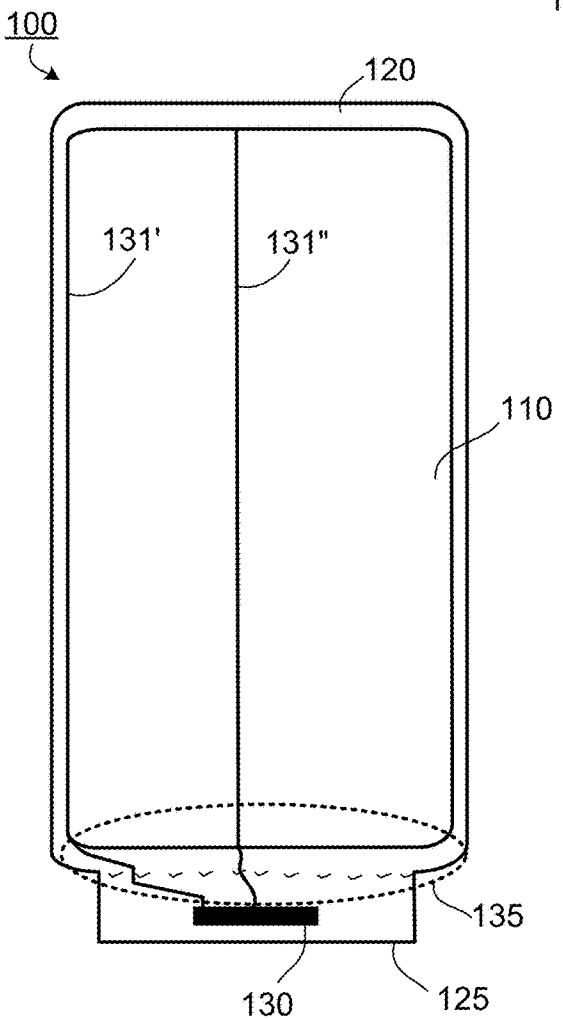
FIG. 1A is a plan view of a portion of an example active matrix organic light emitting diode (AMOLED) display panel.

Referring to FIGS. 1A and 1B, an active matrix organic light emitting diode (AMOLED) display panel 100 includes an active area 110 composed of an array of pixels 112 each having one or more OLEDs that emit light during operation. Active area 110 is surrounded by a bezel 120 which frames the edges of active area 110 and provides space for circuitry for operating the display and/or other devices, such as front facing sensors. Display panel 100 also includes various display driver circuits including a column line driver 130, scan line drivers 140, a timing controller 150, which are electrically connected to a system on chip (SOC) controller 160. SOC controller 160 is connected via a bus to one or more other electronic components 199 including memory (e.g., volatile and non-volatile memory) and includes one or more processing units (e.g., DPUs, GPUs). SoC controller 160 and the one or more electronic components can be mounted on a common circuit board 190 electrically connected to the display panel 100. Collectively, the various electronic components in communication with the active area 110 constitute a computing system.

Display panel 100 also includes a flex circuit 125 that can support one or more integrated circuit chips (e.g., such as column driver 130 as depicted in FIG. 1A). Flex circuit 125 can be folded behind active area 110, hiding the integrated circuit chips behind the active area.

Active area 110 includes multiple vertical column data lines 131 running along the long direction of the display (i.e., the y-axis or vertical axis). The column data lines run along the vertical length of active area 110 and connect to column driver 130 at the base of the display panel 100. Active area 110 also includes multiple horizontal scan lines 141 (along the x-direction) that connect to scan line drivers 140.

FIG. 1A also shows an area 135 of the display which encompasses the portion in which column data lines 131 run from column driver 130 to the active area 110. For the geometry illustrated, column driver 130 is located approximately equidistance from the vertical edges of active area 110 although other arrangements are possible (e.g., a column IC driver can be located closer to one edge than the other). Because column driver 130 has a narrower width than active area 110, this means that a length of column data lines running close to the vertical edges of active area 110 are longer than a length of column data lines nearer the center of active area 110. The length difference is exemplified by a first column data line 131' that runs close to the left vertical edge of active area 110 and a second column data line 131" that runs close to the center. The potential significance of this data line length difference is discussed below.

Display panel 100 has a resolution corresponding to the number of pixels 112 in the panel. In some embodiments, panel 100 has a high resolution (e.g., over a million pixels). For example, panel 100 can be a FHD display panel (i.e., 1080×2340 pixels), a QHD display panel (i.e., 1440×3200 pixels), 4K UHD (i.e., 2160×3840 pixels), etc. Various aspect ratios (i.e., length to width ratio) are possible, including 16:9, 4:3, and 21:9, for example.

Figure 1C:
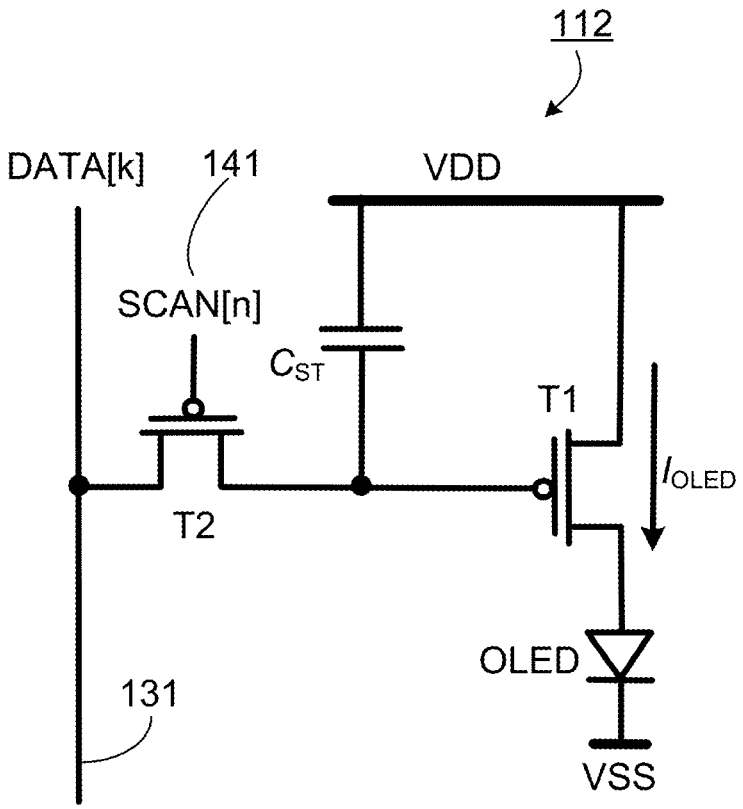
FIG. 1C is a circuit diagram of an example pixel circuit for an AMOLED display panel.

In general, in an AMOLED display, each pixel 112 includes a pixel circuit that has multiple transistors, one or more capacitors, and an organic light emitting diode OLED. FIG. 1C shows an example pixel circuit that includes two transistors, T1 and T2, and one capacitor, $C_{ST}$. Data line 131 connects to the source electrode of T2 while scan line 141 connects to the gate electrode of that transistor. T2's drain electrode connects to both $C_{ST}$ and to the gate electrode of T1, which controls electrical current flow to the OLED. VDD and VSS refer to the power supply potentials connected across the OLED, which deliver current to the OLED while T1 acts as an electrical current control circuit according to its gate electrode voltage. More generally, other pixel circuits are possible, including circuits that include more than two transistors (e.g., seven transistors).

The amount of light emitted by each pixel 112 for a given image frame depends on a gray level voltage, $V_{DATA}$, for that pixel during the frame. The gray level voltage for each pixel can be updated for each frame to display dynamic imagery. The rate at which the frames are updated is referred to as the frame refresh rate, and can be 60 Hz or higher (e.g., 120 Hz or higher, 240 Hz or higher).

Figure 2:
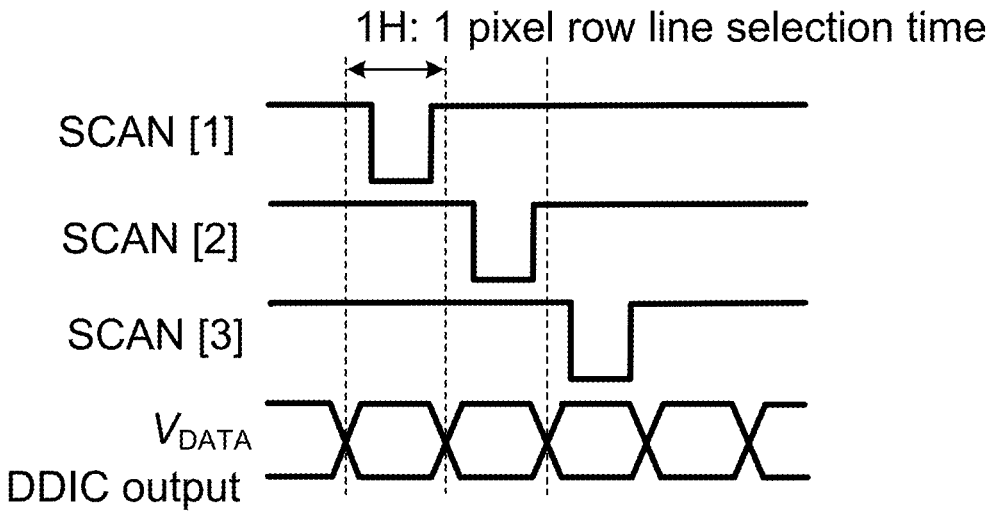
FIG. 2 shows plots showing timing of scan signals and data signals for an example addressing scheme for an AMOLED display.

Referring to FIG. 2, in a typical active matrix addressing scheme, scan signals are sequentially delivered to each scan line 141 of the display by scan line drivers 140. The pulse length for the scan signals is referred to as the row line time. The relative timing of scan signals for three sequential scan lines are illustrated in FIG. 2. Timing controller 150 synchronizes delivery of gray level voltage data via column line driver 130 to each data line 131 so that appropriate gray level voltage data, $V_{DATA}$, is delivered to each pixel. This scheme is repeated for each frame. Accordingly, in some embodiments, the row line time can be extremely short, such as 10 μs or less (e.g., 8 μs or less, 5 μs or less, 4 μs or less, 3 μs or less, 2 μs or less). For example, displays that have a large number of pixel rows and a high refresh rate can have extremely short row line times.

Figure 3B:
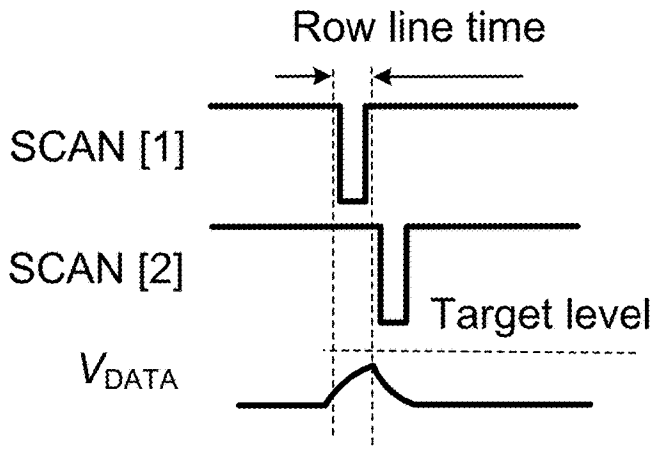
FIG. 3B shows plots of scan and data signals in which a row line time is shorted than a rise time of the data signal for a gray level.
Figure 3A:
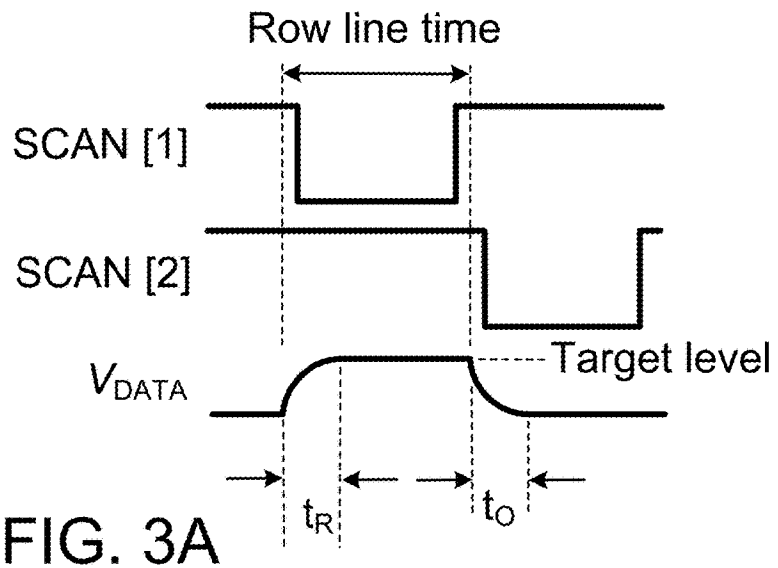
FIG. 3A shows plots of scan and data signals in which a row line time is larger than a rise time of the data signal for a gray level.

It is believed that as the row line time becomes very short, it becomes increasingly difficult for the column line driver ICs to fully charge the data lines to the target $V_{DATA}$ level within the given row line time. Consequently, pixels in the display may reproduce incorrect luminance or color on the screen because the current delivered to the pixel is less than the current needed to generate the appropriate luminance. This effect is illustrated in the plots shown in FIG. 3A and FIG. 3B, which compare scan line pulses for two adjacent scan lines (SCAN[1] and SCAN[2]) as a function of time. The bottom trace in each figure depicts the voltage on a data line during the pulse during on SCAN[1], when the pixel is selected. FIG. 3A shows pulses for a display configuration with a relatively long pulse duration compared to the display configuration depicted in FIG. 3B. For example, FIG. 3A and FIG. 3B can correspond to display configurations having the same pixel resolution but different refresh rates (i.e., a higher refresh rate is depicted in FIG. 3B). Alternatively, or additionally, FIG. 3A and FIG. 3B can correspond to display configurations having the same refresh rates but different pixel resolutions (i.e., a higher pixel resolution is depicted in FIG. 3B).

In either case, due to parasitic capacitance and intrinsic resistance of the data lines, any voltage change on the data line is characterized by a finite rise time, $t_R$, and a finite decay time, to, rather than an instantaneous step function from one voltage level to another. It is further noted that these characteristic voltage rise and decay times can vary depending on a length of the data line. For example, a data line having a longer length, e.g., data line 131' in FIG. 1A described above, can have a longer rise and decay time compared to the rise and decay time of a relatively shorter data line, e.g., data line 131", at the middle of display active area 110.

This effect is illustrated by comparing the $V_{DATA}$ trace in FIGS. 3A and 3B, respectively. As noted previously, the row line time depicted in FIG. 3A is relatively long, and substantially longer than the rise time and decay time for a $V_{DATA}$ change from a base line to a target level. Accordingly, here, for a pixel addressed during SCAN[1], the voltage on the data line rises over $t_R$ to the target level where it remains for the duration of the row line time. At the end of the row line time, $V_{DATA}$ decays from the target level back to the base line.

In contrast, the row line time depicted in FIG. 3B is relatively short, shorter than the rise time for the $V_{DATA}$ change from the base line to the same target level in FIG. 3A. As a result, $V_{DATA}$ does not rise to the target level during the row line time and begins to decay before the target level is reached.

As a result, problems from slow charging of $V_{DATA}$ due to a high RC (resistance, capacitance) and the short line time in an AMOLED display can manifest as a color and/or brightness non-uniformity when displaying certain images. Specifically, portions of image frames which are supposed to have the same color and/or luminance can instead vary where the portions of the display are addressed by data lines having varying length.

Figure 4:
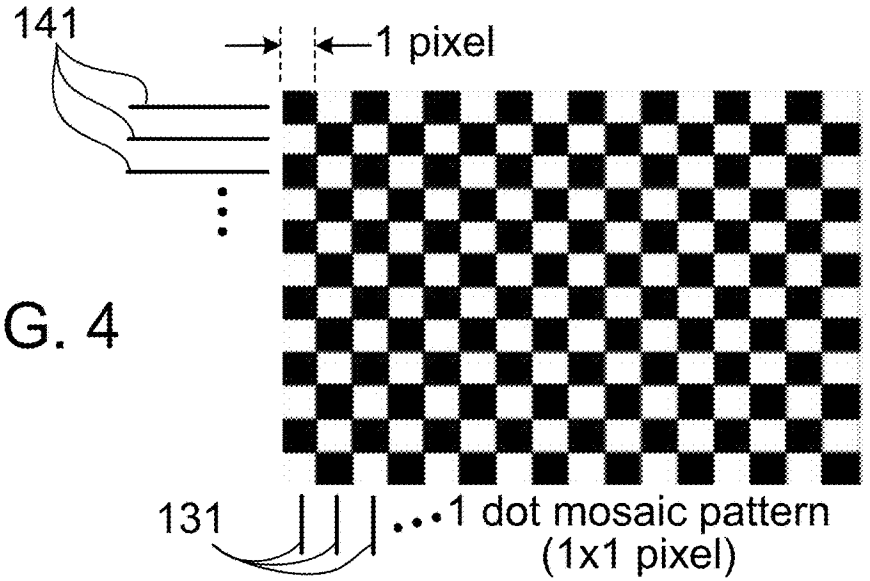
FIG. 4 shows a one dot mosaic pattern.

An example where such non-uniformity may be particularly pronounced is a "one-dot mosaic pattern," illustrated in FIG. 4, which is composed of a checkerboard pattern of white pixels (i.e., highest luminance level) and black pixels (i.e., lowest luminance level). For an image frame containing this pattern, $V_{DATA}$ should alternate from peak-to-peak across the entire dynamic range of $V_{DATA}$ and a maximum rate (i.e., from black to white to black for each alternating pixel). However, in circumstances where the rise and decay times, e.g., for longer data lines, are of insufficient duration to allow $V_{DATA}$ to switch across the requisite amplitude, color non-uniformity across the pattern can occur. For display panel 100, this can include a color shift at edges of the pixel active area compared to the center, corresponding to where the data lines are longer due to the greater separation of these lines at the bottom of the display panel where the data lines extend between the pixel active area 110 and the column driver 130.

This problem can be exacerbated by the high-screen-to-body ratio trend in the industry, as the small bottom bezel increases the line length difference bigger at the panel bottom region. As a result, a luminance/color shift can happen more readily at edges of the display, which is where, in turn, a luminance/color non-uniformity tends to be more evident.

The visual impact of the brightness and/or color variation due to finite data line charging times can be mitigated by reducing a dynamic range of $V_{DATA}$ levels between certain pixels, as explained below. For example, for many displays, there is a non-linear relationship between pixel luminance and gray level, as well as a variation in $V_{DATA}$ steps between consecutive gray levels depending on whether the pixel has low or high luminance. Accordingly, under some circumstances, it is possible to reduce a dynamic range of $V_{DATA}$ for adjacent pixels without significantly impacting the perceptible visual performance of the display.

Figure 5A:
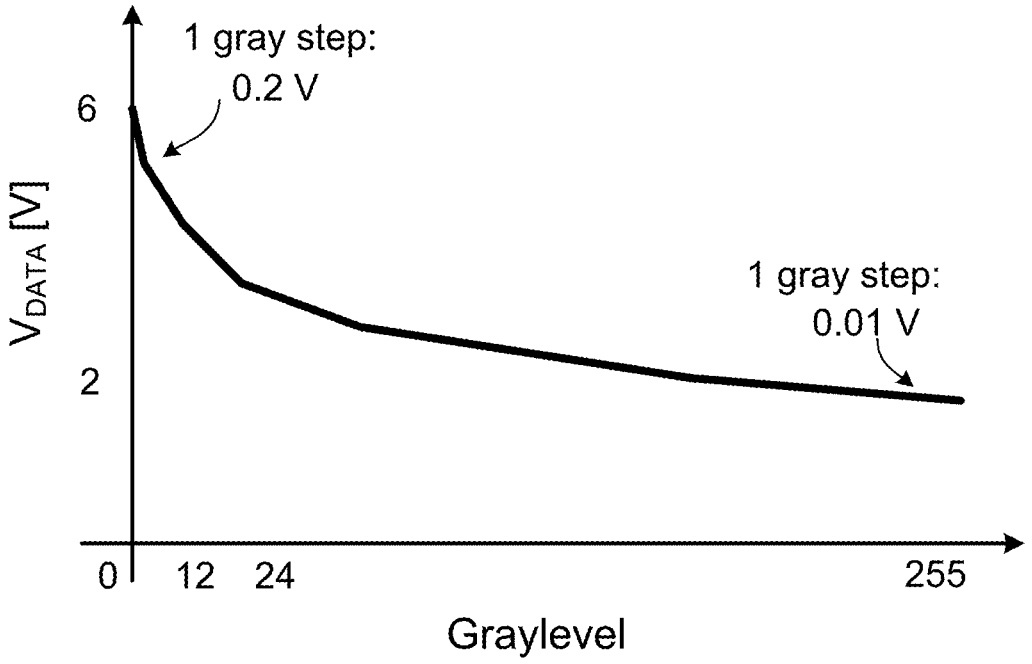
FIG. 5A is a plot showing an example relationship between data line voltage and gray level for an AMOLED display.
Figure 5B:
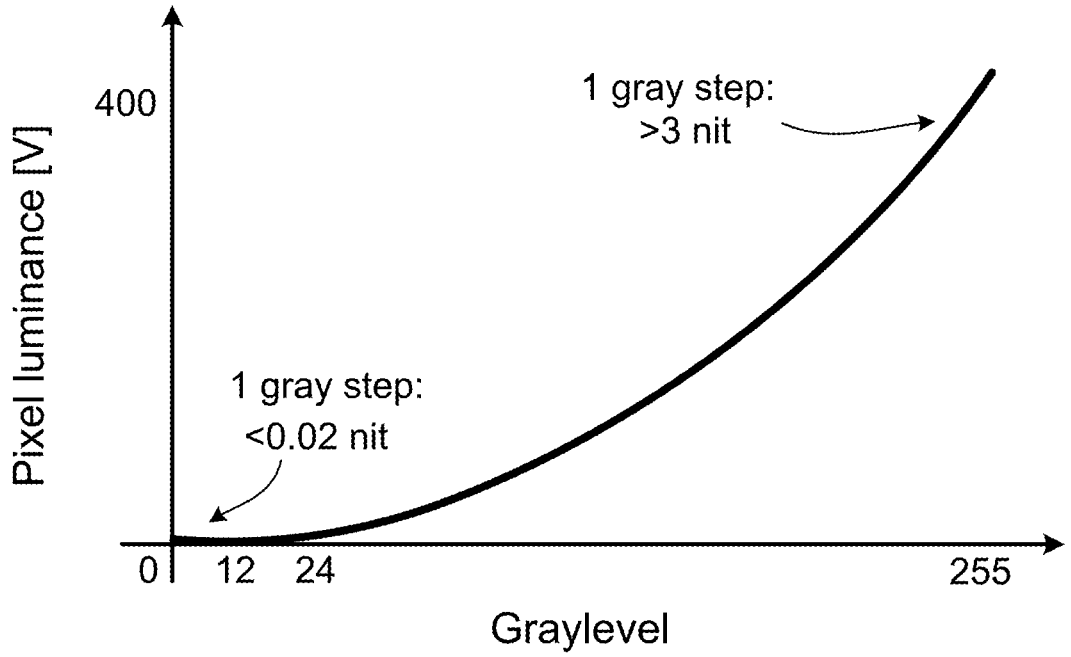
FIG. 5B is a plot showing an example relationship between pixel luminance and gray level for an AMOLED display.

Nonlinear relationships between Gray level and $V_{DATA}$ and between Gray level and Pixel luminance illustrated in FIGS. 5A and 5B, respectively. FIG. 5A shows the relationship between $V_{DATA}$, in Volts, for different gray levels from 0 to 255. The $V_{DATA}$ decreases monotonically from a maximum value of 6 V for gray level 0 to a minimum value of approximately 2 V to 255. The absolute value of the slope of the curve is steepest at low gray level and decreases in gradient as the gray level increases. In particular, in this example, a single gray level step from gray level 0 to gray level 1 is 0.2 V, while the gray level step from 254 to 255 is 0.01 V.

FIG. 5B shows pixel luminance (in nits) from gray level 0 to gray level 255. This curve increases monotonically, but nonlinearly, from 0 to 255. The gradient is lowest at gray level 0 and increases to its steepest at gray level 255. Specifically, the gray level step from 0 to 1 increases luminance less than 0.02 nits, while the gray level step from 254 to 255 increases luminance over 3 nits.

It bears repeating that the curves shown in FIGS. 5A and 5B are examples only. Other displays can exhibit different relationships and/or values but similarly shaped curves.

Based on this behavior, it is possible to adjust gray level values of black or close to black pixels to operate at slightly higher gray levels than the image data value. When the black or close to black pixel is neighboring (e.g., vertically neighboring, addressed by the same column data line) with one or more relatively bright pixels, the increased brightness associated with the elevated gray level is barely perceptible. For example, for an 8-bit color image (e.g., where each RGB subpixel can have a gray level from 0-255), pixels with a gray level of 4 or lower can have their gray level increased, e.g., by 1-5 gray levels when the pixel neighbors (e.g., vertically neighbors) a pixel having a gray level of, e.g., 200 or more.

By way of further example, when an image is composed of a 1 dot mosaic to be displayed on a display with a 400 nit brightness setting, the original display brightness is 200 nit (as only half of the pixels are on with the image pattern). A three gray level increase to the black pixels increases the luminance becomes 200.007 nit, i.e., a 0.007 nit increase. However, as the gray levels are increased by three for black pixels, $V_{DATA}$ swing range in the data line decreases by around 0.6 V (out of 4 V peak-to-peak swing). This is about a 15% reduction in the voltage swing range.

Accordingly, as the voltage swing range decreases, the luminance/color change from slow pixel charging can be mitigated.

Following this method, the gray level shift happens only when a bright pixel is neighboring (e.g., vertically neighboring), so it does not compromise dark pixels and degrade image quality for large dark areas in an image, keeping the high contrast ratio of AMOLED displays.

Figure 6B:
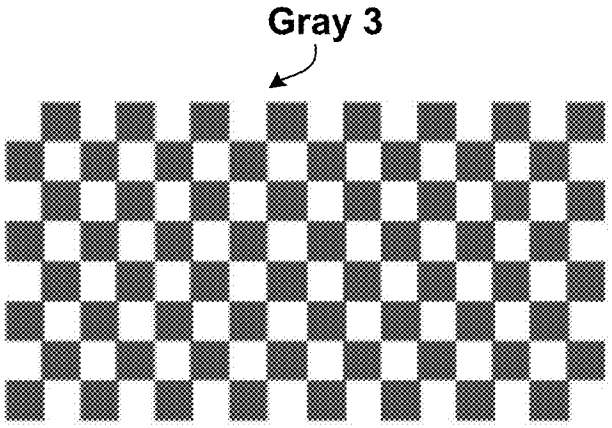
FIGS. 6A-6B show one dot mosaic patterns for in which dark pixels have gray level 0 and gray level 3, respectively.
Figure 6A:
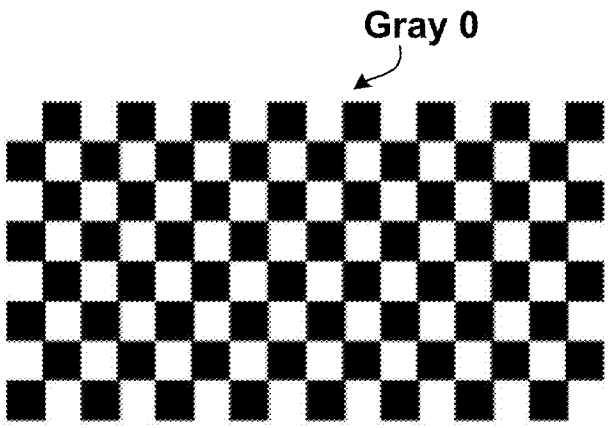

This effect, for a one dot mosaic pattern, is illustrated in FIGS. 6A and 6B, which show one dot mosaic patterns at a gray level of zero (FIG. 6A) and at a gray level of three (FIG. 6B), respectively. In both cases, the gray level of white pixels is 255 (i.e., the maximum value).

Figure 7:
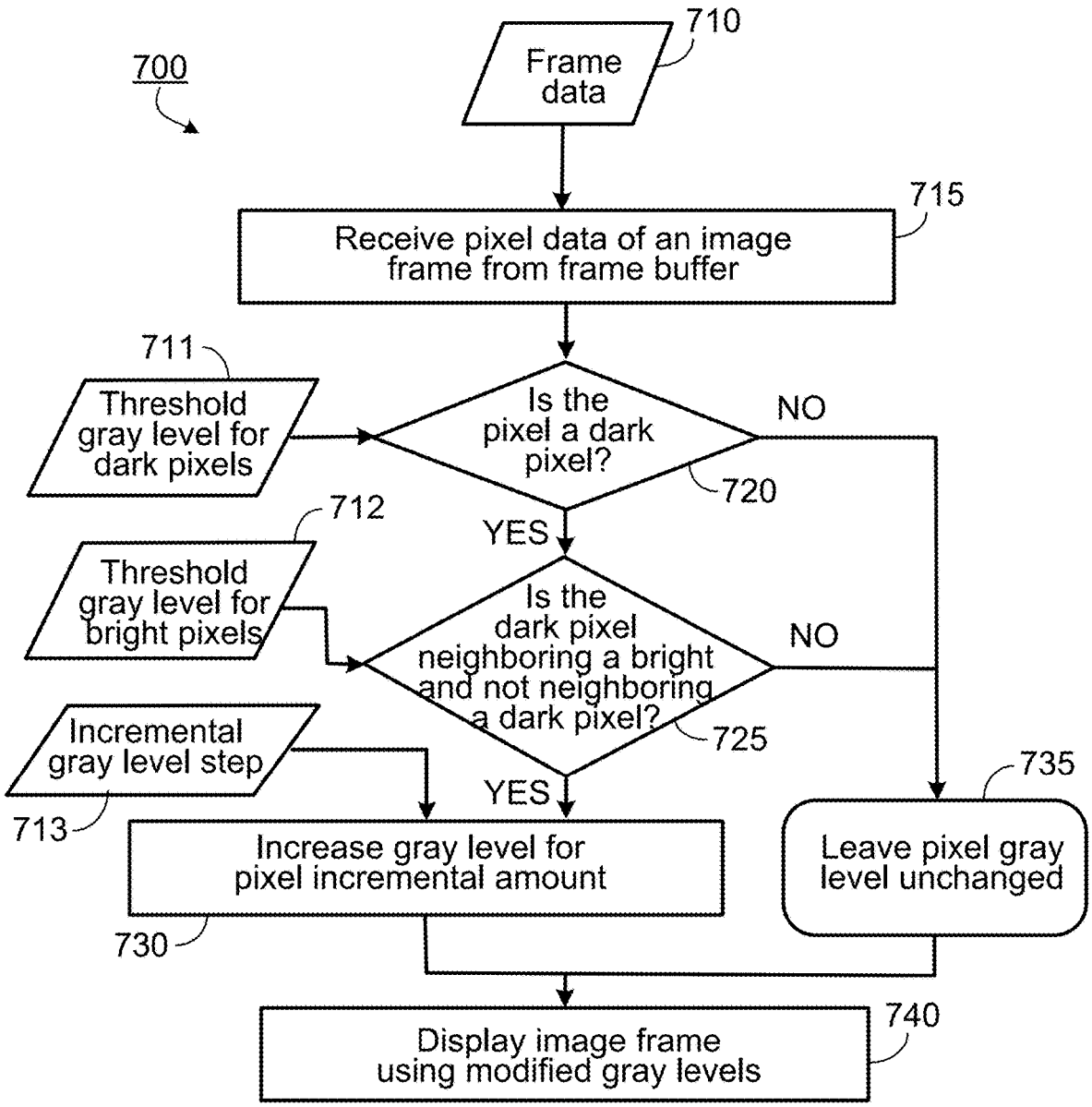
FIG. 7 is a flow chart showing an example technique for generating modified image frame data including dark pixels with modified gray levels.

In some implementations, selective black level control in an active matrix display can be performed according to the flowchart 700 shown in FIG. 7. The method can be implemented by the display driver integrated circuit or in a graphics or central processing unit that is part of the device incorporating the display panel. Initially, the system specifies a threshold gray level for "dark" pixels (711) and a threshold gray level for "bright" pixels (712). For example, for 8-bit color images, a "dark" pixel can be a pixel that has a gray level of 6 or less (e.g., 5 or less, 4 or less, 3 or less, 2 or less, 1, or zero). A "bright" pixel can be a pixel that has a gray level of 200 or more (e.g., 210 or more, 220 or more, 230 or more, 240 or more, 250 or more). For color displays, these thresholds apply one each of the subpixel gray levels. For example, a "dark" pixel can correspond to a pixel with RGB gray levels that each fall below the threshold value. Correspondingly, a "bright" pixel can correspond to a pixel with RGB gray levels that each exceed the threshold value. In some embodiments, a different threshold can be established for each color. For instance, green subpixel gray levels can have a different (e.g., lower for dark pixels and/or higher for bright pixels) threshold gray level than blue or red.

The system also specifies an incremental gray level step (or steps) 713. This value or values refers to the incremental increase in gray level that is to be applied to dark pixels that are neighbored (e.g., vertically neighbored) by bright pixels to mitigate the effects of large $V_{DATA}$ steps in the data signals.

Generally, the thresholds 711 and 712 and incremental gray level step (or steps) 613 are selected based such that they result in a meaningful reduction in the voltage transition for the $V_{DATA}$ signal from a dark pixel to a bright pixel without significantly impacting the luminance from the pixel. For example, thresholds 711 and 712 and the incremental gray level step 613 can be selected so that a $V_{DATA}$ voltage transition from a black pixel (e.g., 0, 0, 0 for the RGB gray level) to a white pixel (e.g., 255, 255, 255) is reduced by 5% or more (e.g., 7% or more, 10% or more, 12% or more, 15% or more, such as up to 20%). The luminance of the dark pixel can increase to 5% or less (e.g., 4% or less, 3% or less, 2% or less, 1% or less, 0.5% or less, 0.1% or less) of the luminance of the white pixel.

The threshold and gray level step values can be programmed into the display's firmware or established later by the integrator of the display, e.g., into a mobile device, or the end user. In some embodiments, these thresholds are established in a calibration process for the display.

Image frame data 710 is typically provided to the display driver from a frame buffer and is composed, for each frame, of a gray level for each subpixel. In step 715, a data processing unit receives the frame data 710 and identifies, in process 720, whether each pixel in an image frame is a dark pixel based on the dark pixel threshold value 711.

For those pixels that fall at or below the dark pixel threshold, i.e., that are identified as dark pixels, the algorithm determines whether the dark pixel is both neighbored by a bright pixel in vertical direction (y-axis) and not neighbored by a dark pixel in process 725. This determination can be made by checking whether each pixel adjacent to a dark pixel meets or exceeds the bright pixel threshold 712.

For dark pixels that are neighbored by bright pixels and not by another dark pixel, the gray level value is increased by an incremental amount 713 in process 730. Each of these pixels can be increased by the same incremental amount regardless of their gray level, or different incremental amounts can be used depending on gray level. Alternatively, or additionally, the incremental amount can vary depending on the gray level of the neighboring bright pixel. For example, a larger incremental amount can be used where the bright neighboring pixel significantly exceeds the threshold amount 712.

The gray level for pixels that are not dark or dark pixels that are not neighbored by bright pixels remains unchanged (process 735).

Finally, the algorithm combines the modified dark pixels with the unchanged pixels to provide image data composed of the modified gray levels and displays the image with the display (process 740).

Other factors can also be used to determine the modifications to dark pixel gray levels. For example, the incremental change to dark pixel gray level and be adjusted based on the brightness of the entire image frame. For instance, brighter images can utilize a higher incremental change to dark pixels than darker images. This can be established on a frame-by-frame basis or can be modified based on display settings via the operating system of the device. For example, if a user increases the brightness of the display, or if the display brightness is increased automatically based on an ambient light sensor measurement, the device can automatically adjust the incremental change to dark pixels. If the display's brightness is set to 400 nits, for example, the dark pixel threshold can be set to gray level 4, the bright pixel threshold to 200, and the incremental change can be set to 3. Alternatively, or additionally, for a display brightness setting of 100 nits, the dark pixel threshold can be set to gray level 2 and the bright pixel threshold set to 250. The incremental gray level change for this scenario can be set to 1. At very low brightness settings (e.g., 20 nits or lower), the image data modification can be switched off.

Image data modification can be switched off (automatically or by the user) in other situations too. For example, when HDR (high dynamic range) content is displayed, or in other scenarios where very low black level luminance is desirable, the image data modification can be switched off.

In some embodiments, only a single color channel can be processed in a full color display. For example, in some implementations, one or two of the three color channels may be more susceptible to the slow charging effects described above. In such instances, the image data modification techniques described herein can be applied only to those color channels. Limiting the processing to only one or two color channels can reduce the data processing resources needed for implementing the techniques.

Alternatively, or additionally, the image data modification techniques can be applied to image data for only certain regions of the display panel, such as at the long edges of the display. The gray levels for columns lines at or near the center of the display (e.g., the middle 50% of the columns) can be left unchanged, changed by a smaller increment, or based on lower dark pixel thresholds and/or higher bright pixel thresholds, while the gray levels for pixels at the left and right sides of the displays (e.g., the 25% of the columns closest to each edge) can be modified by a greater degree.

In some implementations, the dark and bright pixel thresholds and/or incremental modification can vary depending on the length of the data line. Longer data lines can have higher dark pixel thresholds than relatively shorter data lines. Longer data lines can have lower bright pixel thresholds than the relatively shorter data lines. Alternatively, or additionally, longer data lines can have larger incremental gray level increases than the relatively shorter data lines.

While example embodiments are disclosed above, other implementations are possible. For example, while a certain arrangement of column driver 130 relative to display active area 110 is depicted in FIG. 1A, other geometries are possible. For example, a column driver can be located closer to one of the display's edges than another, rather than approximately equidistant between the vertical edges resulting in relatively short data lines at one edge of the pixel active area and the lines getting increasingly longer towards the opposite edge.

Generally, the techniques disclosed above can be utilized in AMOLED panels in a variety of form factors, such as mobile phones, tablet computers, laptop computers, desktop monitors, and televisions. Use in wearable devices, such as smart watches and head-mounted displays (e.g., for AR or VR applications), is also contemplated. Use of the technology in automotive displays is also contemplated. Moreover, while the foregoing examples refer to an AMOLED display panel, more generally, the techniques disclosed herein can be applied to other types of actively addressed display panels, such as active matrix LCD display panels and active matrix microLED display panels.

In general, aspects of the technology disclosed herein may be implemented in hardware, software, firmware or any combination thereof. Where implemented as software, the method steps, acts or operations may be programmed or coded as computer-readable instructions and recorded electronically, magnetically or optically on a non-transitory computer-readable medium, computer-readable memory, machine-readable memory or computer program product. In other words, the computer-readable memory or computer-readable medium comprises instructions in code which when loaded into a memory and executed on a processor of a computing device cause the computing device to perform one or more of the foregoing method(s). In a software implementation, software components and modules may be implemented using standard programming languages including, but not limited to, object-oriented languages (e.g., Java, C++, C #, Smalltalk, etc.), functional languages (e.g., ML, Lisp, Scheme, etc.), procedural languages (e.g., C, Pascal, Ada, Modula, etc.), scripting languages (e.g., Perl, Ruby, Python, JavaScript, VBScript, etc.), declarative languages (e.g., SQL, Prolog, etc.), or any other suitable programming language, version, extension or combination thereof.

A non-transitory computer-readable medium can be any means that contain, store, communicate, propagate or transport the program for use by or in connection with the instruction execution system, apparatus or device. The computer-readable medium may be electronic, magnetic, optical, electromagnetic, infrared or any semiconductor system or device. For example, computer executable code to perform the methods disclosed herein may be tangibly recorded on a computer-readable medium including, but not limited to, a floppy-disk, a CD-ROM, a DVD, RAM, ROM, EPROM, Flash Memory or any suitable memory card, etc.

The method may also be implemented in hardware. A hardware implementation can employ discrete logic circuits having logic gates for implementing logic functions on data signals, an application-specific integrated circuit (ASIC) having appropriate combinational logic gates, a programmable gate array (PGA), a field programmable gate array (FPGA), etc. The hardware can be a computing systems that includes one or more computer processors that execute computer-executable program instructions stored in memory. For example, one or more computer processors can be a microprocessor, digital signal processor (DSP), application specific integrated circuit (ASIC), or one or more field programmable gate arrays (FPGA). The computer processor may further include a PLC, programmable interrupt controller (PIC), programmable logic device (PLD), programmable read only memory (PROM), electronically programmable read only memory (EPROM or EEPROM), or other similar devices.

A number of implementations have been described. Other embodiments are in the following claims.

What is claimed is:

1. A method, comprising:

receiving, by a computing system, initial image frame data corresponding to an image frame for display on a display panel, the display panel comprising an array of pixels electrically connected to display driver circuitry of the computing system, wherein a luminance of each pixel of the display panel during presentation of the image frame corresponds to a voltage provided to the pixel based on a gray level for that respective pixel in the initial image frame data;

identifying, by the computing system, dark pixels corresponding to pixels in the image frame for which the gray levels of the respective pixels are at or below a first threshold gray level, according to the initial image frame data;

identifying, by the computing system, pixels to be modified corresponding to a subset of the dark pixels that are neighbored by at least one bright pixel with a gray level at or exceeding a second threshold gray level, according to the initial image frame data;

increasing by an incremental gray level amount, by the computer system, the gray level of the pixels to be modified, to provide modified image frame data composed of:

(i) the dark pixels that are neighbored by at least one bright pixel having gray levels that have been increased with respect to gray levels in the initial image frame data by the incremental gray level amount, and (ii) other pixels that have gray levels from the initial image frame data; and displaying the image frame on the display panel using the modified image frame data.

2. The method of claim 1, wherein identifying the pixels to be modified further comprises identifying the pixels to be modified by the computing system as dark pixels that are not neighbored by another dark pixel.

3. The method of claim 1, further comprising varying at least one of the first threshold gray level, the second threshold gray level, and the incremental gray level amount based on a brightness setting of the display panel.

4. The method of claim 3, wherein the computing system is configured:

for a first brightness setting, to set the incremental gray level amount to a first value;

for a second brightness setting that is lower than the first brightness setting, to set the incremental gray level amount to a second value that is lower than the first value.

5. The method of claim 1, wherein the pixels to be modified are only pixels located at or near an edge of the display panel.

6. The method of claim 1, wherein the display panel is a full color active matrix display panel and the dark pixels are identified based on a gray level for each color subpixel, according to the initial image frame data.

7. The method of claim 1, wherein:

the display panel is a full color active matrix display panel; and the dark pixels are identified based on a gray level for only one color subpixel, according to the initial image frame data.

8. The method of claim 1, wherein values for the incremental gray level amount are different for data lines having different lengths, each data line of the display panel delivering the voltages to a corresponding column of pixels.

9. The method of claim 8, wherein a first value for the incremental gray level amount is greater for a first data line than a second value for the incremental gray level amount for a second data line that is shorter than the first data line.

10. The method of claim 1, wherein a dynamic range of a voltage applied to a pixel when displaying the image frame is reduced using the modified image frame data compared to a dynamic range of the voltage applied to the pixel for the initial image frame data.

11. The method of claim 1, wherein the display panel is refreshed with a refresh rate of 60 Hz or higher.

12. The method of claim 1, wherein the display panel has a Full High Definition resolution or greater.

13. A device, comprising:

a display panel comprising an array of pixels, wherein a luminance of each pixel of the display panel during presentation of an image frame corresponds to a voltage provided to the pixel based on a gray level for that respective pixel in the initial image frame data; and a computing system in communication with the display panel and configured to provide the voltages to the pixels during operation of the device, wherein the computing system is configured to:

receive initial image frame data corresponding to the image frame for display on the display panel;

identify dark pixels corresponding to pixels in the image frame for which the gray levels of the respective pixels are at or below a first threshold gray level, according to the initial image frame data;

identify pixels to be modified corresponding to a subset of the dark pixels that are neighbored by at least one bright pixel with a gray level at or exceeding a second threshold gray level, according to the initial image frame data;

increase by an incremental gray level amount the gray level of the pixels to be modified, to provide modified image frame data composed of:

(i) the dark pixels that are neighbored by at least one bright pixel having gray levels that have been increased with respect to gray values in the initial image frame data by the incremental gray level amount, and (ii) other pixels that have gray levels from the initial image frame data; and display the image frame on the display panel using the modified image frame data.

14. The device of claim 13, wherein the computing system comprises a column line driver and a scan line driver, the column line driver and scan line driver being configured to synchronously apply voltages to column lines and scan lines of the display panel, respectively, to display the image frame on the display panel using the modified image frame data.

15. The device of claim 13, wherein the display panel is a full color active matrix display panel.

16. The device of claim 13, wherein the computing system is configured so that the pixels to be modified are only pixels located at or near an edge of the display panel.

17. The device of claim 13, wherein the computing system is configured so that a dynamic range of a voltage applied to a pixel when displaying the image frame is reduced using the modified image frame data compared to a dynamic range of the voltage applied to the pixel for the initial image frame data.

18. The device of claim 13, wherein the display panel has a resolution of Full High Definition or higher.

19. The device of claim 13, wherein the display panel is an organic light emitting diode (OLED) display panel.

20. The device of claim 13, wherein the device is a smart phone, a tablet computer, or a wearable device.

* * * * *